United States Patent [19]

Peters et al.

[11] Patent Number: 4,629,079

[45] **Date of Patent: * Dec. 16, 1986**

[54] TRANSPORT CARRIAGE

[75] Inventors: Penn A. Peters; Cleveland J. Biller, both of Morgantown; David D. Johnson, Booth, all of W. Va.

[73] Assignee: The United States of America as represented by the Secretary of Agriculture, Washington, D.C.

[ * ] Notice: The portion of the term of this patent subsequent to Feb. 19, 2002 has been disclaimed.

[21] Appl. No.: 646,730

[22] Filed: Sep. 4, 1984

Related U.S. Application Data

[63] Continuation-in-part of Ser. No. 530,829, Sep. 9, 1983, Pat. No. 4,500,004.

[51] Int. Cl.[4] ..... B66C 17/06; B66C 21/00; F42B 13/16

[52] U.S. Cl. ..... 212/98; 212/110; 212/80; 212/122; 212/89; 104/93

[58] Field of Search ..... 212/71–122; 104/93, 112–113

[56] References Cited

U.S. PATENT DOCUMENTS

| | | | |
|---|---|---|---|
| 75,946 | 3/1868 | Miller | 212/122 |
| 475,710 | 5/1892 | Spilsbury | 212/107 |
| 566,849 | 9/1896 | Dusedau | 212/80 |
| 876,874 | 1/1908 | Hausfelder | 212/89 |
| 1,205,778 | 11/1916 | Opsal | 212/108 |
| 3,083,839 | 4/1963 | McIntyre | 212/122 |
| 3,948,398 | 4/1976 | Christensen | 212/122 |
| 4,109,799 | 8/1978 | Munn | 212/83 |
| 4,453,642 | 6/1984 | Myhre | 212/89 |
| 4,454,951 | 6/1984 | Kuehn | 212/106 |
| 4,500,004 | 2/1985 | Peters et al. | 212/122 |

FOREIGN PATENT DOCUMENTS

| | | | |
|---|---|---|---|
| 961263 | 5/1970 | France | 212/108 |
| 751683 | 7/1980 | U.S.S.R. | 104/93 |

OTHER PUBLICATIONS

The Pointer, Nov. 1947, vol. IV, No. 11, pp. 1–8.

*Primary Examiner*—Sherman D. Basinger
*Assistant Examiner*—R. B. Johnson
*Attorney, Agent, or Firm*—M. Howard Silverstein; David G. McConnell

[57] ABSTRACT

An improved carriage for use in a skyline logging system simultaneously utilizing more than one load cable wth the same carriage for connecting to and dragging separate "turns" of logs from the area in which they were felled to a landing area next to the yarder machine.

1 Claim, 3 Drawing Figures

TRANSPORT CARRIAGE

This is a continuation-in-part of application Ser. No. 530,829, filed Sept. 9, 1983, now U.S. Pat. No. 4,500,004.

FIELD OF THE INVENTION

The invention relates to an improved transport carriage for use in skyline logging systems, and more particularly pertains to a transport carriage that accommodates more than one load line.

BACKGROUND OF THE INVENTION

Skyline logging systems are, in general, capable of handling only a single load line, that load line bearing a single "turn" of logs. Some systems, as for example that disclosed in U.S. Pat. No. 4,136,786 to Morrow, et al, have suggested that a plurality of choker or load lines each bearing a "turn" of logs may be utilized. However, even these systems would require that the logs of all of the "turns" be picked up from the area vertically below the track cable or high line of the skyline logging system. A "turn" of logs could not be recovered from an area away from the line of the high line since this would act to twist the carriage on the high line even though it was already bearing several turns of log suspended directly from that carriage. The resulting forces would not be on a line through the track block of the carriage onto the high line but would be pivoted from a line through the track block raising the possibility of the carriage slipping off the high line and thereby rendering the system inoperable.

Since not all logging operations occur directly below a high line, it is necessary with the carriage mechanisms to either transport the logs to a point directly underneath the high line or make due with a single "turn" of logs per cycle. Therefore, there is a need for any improved transport carriage for use in a high line skyline logging system, whereby multiple "turns" of wood may be transported simultaneously while still retaining the optimum operating conditions for the carriage as it moves along the high line.

DESCRIPTION OF THE PRIOR ART

U.S. Pat. No. 377,063 to Chambard discloses a hay elevator for raising and moving a load of hay. There are two pulleys J shown in FIG. 1 which are movable relative to one another and also movable relative to the carriage B itself.

U.S. Pat. No. 784,167 to Louden discloses an elevator carrier in which there are two pulley arrangements I, which are movable relative to one another.

U.S. Pat. No. 1,151,299 to Shaw discloses a high line logging system which includes a single load line to carry a single turn of logs to the landing point on any one transport carriage.

U.S. Pat. No. 1,569,176 to Dunham discloses a skyline logging system having a single lifting (or load) block in the same plane as the track block.

U.S. Pat. No. 1,756,732 to Dickinson discloses a skyline logging system in which the load block is pivotable.

U.S. Pat. No. 4,136,786 to Morrow discloses a logging system and yarder therefore. FIGS. 1 and 2 disclose a carriage with means for supporting a plurality of choker cables.

U.S. Pat. No. 4,262,811 to Montague discloses a log transporting carriage assembly which includes a carriage lock and unlock mechanism with two operable positions. The first position releases a main or load line relative to the carriage while locking the carriage along the high or skyline. The second position reverses these effects. The loadline block is involved in the locking of the carriage to the main line and is not free to swivel relative thereto.

SUMMARY OF THE INVENTION

This invention provides an improved carriage for use in a skyline logging system which allows multiple "turns" of timber to be transported by a single carriage. Those "turns" of wood may be recovered from positions other than those immediately and vertically below the skyline cable of a skyline logging system.

The carriage includes a track block and a pair of load blocks where the track block is retained within a carriage frame. Means are provided for connecting the load blocks to the carriage frame. A means is provided on the carriage frame that releasably clamps the carriage to a skyline or high line passing through the carriage and under the track block. An additional means is provided on the carriage frame which releasably clamps the carriage to one or more load lines passing through the carriage frame and over the load blocks. The load blocks are connected to the carriage frame by pivotable connectors.

BRIEF DESCRIPTION OF THE DRAWINGS

The best mode contemplated in carrying out this invention is illustrated and better understood by reference to the following detailed description when considered in conjunction with the accompanying drawings, in which.

DESCRIPTION OF THE PREFERRED EMBODIMENT

Figure 1:
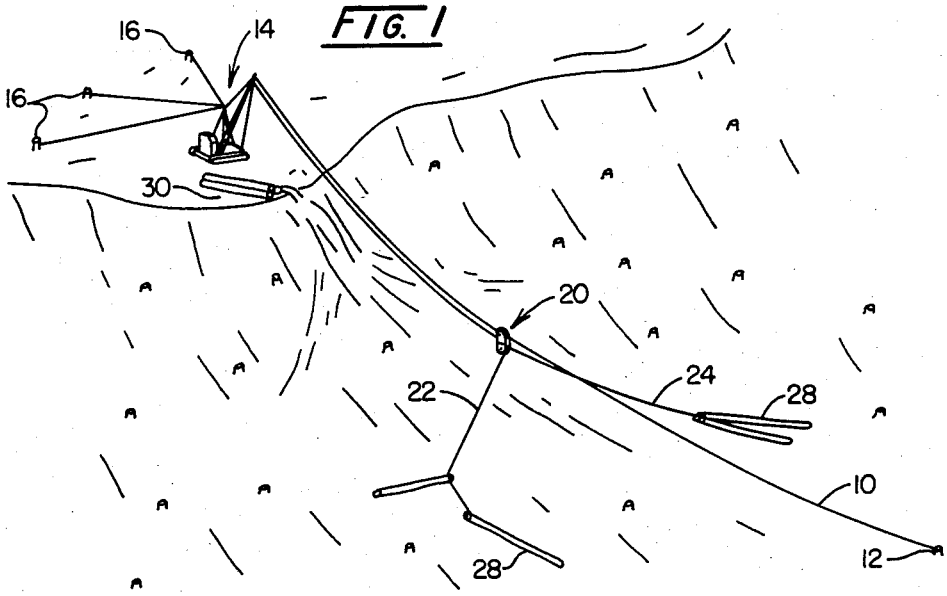
FIG. 1 is a schematic view of a skyline logging system with a carriage according to the present invention.

With reference to FIG. 1, a skyline logging system includes a high line or skyline 10 connected at its two ends respectively to a ground anchor 12 (preferably a stump) and a yarder machine 14 (usually a modified crane assembly). The yarder machine 14 is conventionally anchored to the ground at several points 16 in order for the yarder machine 14 to maintain the tension on the high line 10.

A carriage 20 rides along the skyline 10 with load lines 22, 24 passing through the carriage 20 to "turns" of logs 28. In the operation of a skyline logging system, the "turns" of logs may be drawn up into the air to be suspended directly below the carriage 20 or may be dragged along the ground from the place where they were felled to a landing area 30 adjacent the yarder machine 14.

It will be appreciated that the operation of a cable over a pulley or sheave is optimized when the direction of the application of force to the cable is perpendicular to the axis of the block or pulley. If the cable and pulley are not so oriented then side forces are imparted to the block and in fact the block may slip sideways on the cable. As a result the carriage or track block may jump off the cable or become entangled in the cable thereby rendering the block inoperable with respect to that cable.

In a carriage of the design known in the prior art having a single load block and a single track block vertically disposed relative to one another, the force applied to the high line cable by the track will necessarily be in the preferred direction. However, if the load block is located in such a way that the force on the load cable is offset, then the force on the highline cable will not be in the preferred direction and malfunction could occur.

Figure 2:
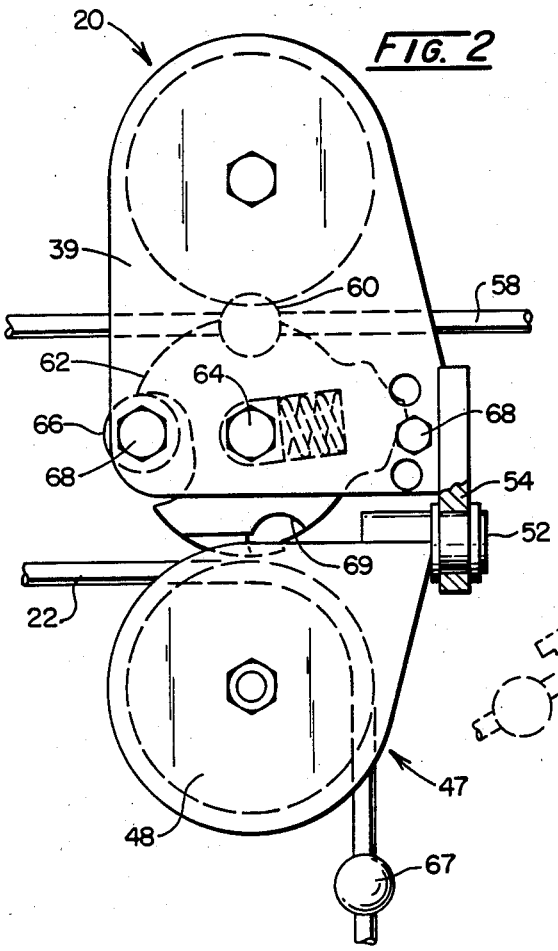
FIG. 2 is an enlarged side elevational view of the carriage of FIG. 1.
Figure 3:
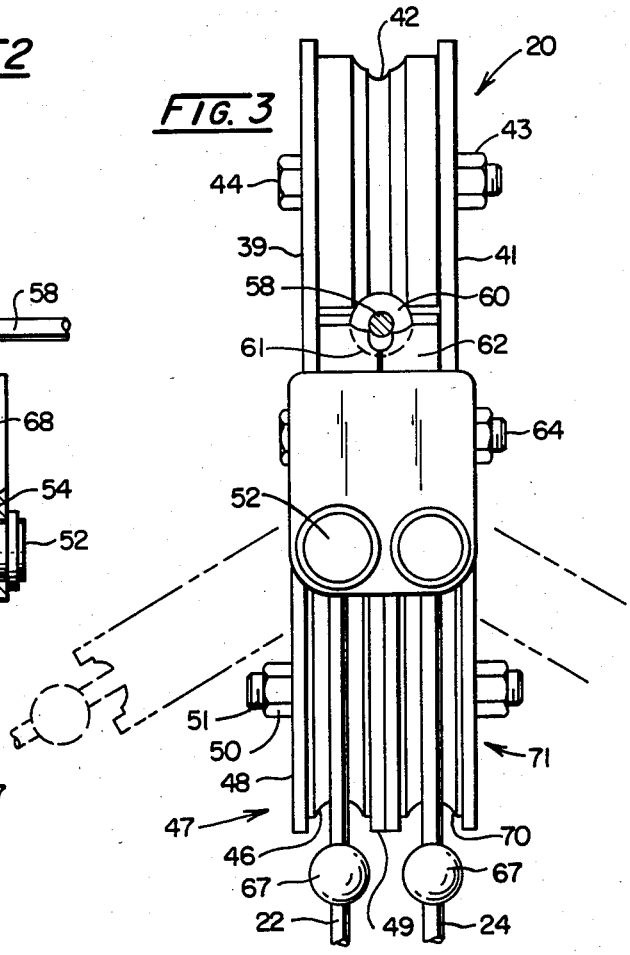
FIG. 3 is a front elevational view of the carriage of FIG. 2, partially in section.

Illustrated in FIGS. 2 and 3 is a carriage 20 which includes two pieces of flat plate 39, 41. A track block 42 is retained between the plates 39, 41 by a nut 43 and bolt 44 combination which allows track block 42 to freely rotate within the carriage frame formed by plates 39, 41.

The load blocks 46, 70 are mounted symmetrically as a pair below the track block 42 and are structurally identical. Therefore, only one will be described in detail. The first load block 46 is retained between separate plates 48, 49 by a nut 50 and bolt 51 combination allowing load block 46 to freely rotate between the plates 48, 49.

The first load block 46 and its frame, formed by plates 48, 49, constitute a load block assembly 47 which is pivotably mounted on carriage frame 20 by a male extension 52 from plates 48, 49 which extends through a collar retainer 54 on carriage frame 20.

A track cable 58 passes through carriage frame 20 and under track block 42, passing through a ball stop 60 which is fixedly mounted on the track cable 58 and acts as a stop against which the travel of the carriage may be terminated.

When ball stop 60 is encountered by the carriage 20 along track cable 58, it engages a concave detent 61 in clamping mechanism 62, thereby rotating clamping mechanism 62 about a pivotable connect 64, which is preferrably a nut and bolt combination which retains clamping mechanism 62 between the plates of carriage frame 20, locking the carriage to the track line 58 and releasing load lines 22,24. Additionally acting to retain the plates 39, 41 in properly spaced apart relationship are nuts 66 and bolts 68 connecting means which have been located to prevent interference with the operation of clamping mechanism 62, preferably a Christy type logging highline stopping mechanism as described in U.S. Pat. No. 3,948,398. Clamp mechanism 62 also has a concave detent 69 on its opposite side from detent 61. Detent 69 is positioned to receive a stop ball shown 67 located on load line 22 which will rotate clamping mechanism 62 to lock load line 22 and release the track line 58. There are at least two clamping mechanisms 62, one for each load line and all load lines both must be in the locked position before the track line is released. It can be seen in FIG. 3 that there is an indentation on each clamping mechanism, which, when the indentations are adjacent one another, defines concave detent 61 in a manner such that the single ball stop 60 on track line 58 engages both clamping mechanisms when the carriage is locked to the trackline.

A second load block 70 is retained in a second load block frame 71 in identical fashion to load block assembly 47. A second load cable 76 passes over second load block 70 and operates its incorporated Christy type clamping mechanism 62.

When two load cables 22, 24 are each bearing the weight of "turns" of timber at different angles from each other the two load blocks 46, 70 may be pivoted such that there is an angle between them. In this case, which easily occurs when "turns" of timber are dragged from different locations at the same time, the entire carriage assembly 20 will inherently self adjust its position so that the components of force will resolve themselves. No side forces will be present on the carriage because of the relative swiveling of the first and second load blocks 46 and 70 respectively about their respective pivot points. In any event, any minor side forces on track cable 58 will be minimized by the configuration above described.

It will be appreciated that a plurality of additional load blocks such as load block assembly 71 may be disposed upon such a carriage frame, and such auxilliary load blocks may each bear a load cable capable of handling a "turn" of timber. However, an observation of the apparatus makes clear that both balls 67 on cables 22 and 24 must engage their associated recess 69 before ball 60 on cable 58 is released; neither cable 22 or 24 can release cable 58 alone. It is not anticipated that any additional load blocks would include a Christy clamping mechanism for locking and unlocking cable 58.

It will be apparent from the above description that this invention provides an improved carriage for use in a high line logging system in which the carriage can accommodate at least two load lines for bearing "turns" of timber to the landing area near the yarder machine in which each of the load lines passes through a load block assembly that is pivotably attached to the carriage.

Having thus described this invention, what is claimed is:

1. A skyline logging system including a ground anchor, a crane having a vertically extending boom, a high line connected in tension to the anchor and the upper end of the boom, a carriage mounted to move along said high line, a plurality of identical load blocks pivotally mounted on said carriage below said high line and a separate load line means extending from each load block for supporting separate loads, each of said load blocks having an axis of rotation wherein the axes of rotation are coaxial, the carriage including a pair of spaced apart plates, means for securing the plates in relative position with a circular track block and locking means mounted therebetween, said track block being free to rotate about its axis while engaging the high line and not engaging the locking means, means secured to said high line for (1) preventing movement of said carriage away from said crane along said high line, (2) moving the locking means to locking position with respect to the track block and (3) simultaneously unlocking said load blocks, means secured to each load line extending from said load blocks for (1) moving the locking means to locking position with respect to said load line and (2) simultaneously unlocking the track block to rotate, each of said load blocks being circular and secured between a pair of plates, means for holding the pairs of plates associated with said load blocks in relatively stationary position with respect to each other while allowing each load block to rotate about the axis of its circular shape, each pair of plates associated with each load block being pivotally secured to said carriage with the axis of rotation of said pivotal security being substantially perpendicular to the axis of the associated circular shape.

* * * * *